US006830005B2

(12) United States Patent
Dunn

(10) Patent No.: US 6,830,005 B2
(45) Date of Patent: Dec. 14, 2004

(54) BOAT MOUNTED HUNTING BLIND

(76) Inventor: Scott E. Dunn, 3451 Oakhill Dr., North Liberty, IA (US) 52317

( * ) Notice: Subject to any disclaimer, the term of this patent is extended or adjusted under 35 U.S.C. 154(b) by 144 days.

(21) Appl. No.: 10/348,695

(22) Filed: Jan. 22, 2003

(65) Prior Publication Data

US 2004/0139906 A1 Jul. 22, 2004

(51) Int. Cl.[7] ..... B63B 35/00
(52) U.S. Cl. ..... 114/351; 114/361
(58) Field of Search ..... 114/351, 362, 114/353, 354, 61.1

(56) References Cited

U.S. PATENT DOCUMENTS 3,787,912 A 1/1974 Huey, Jr.
3,990,536 A * 11/1976 Wilburn ..... 182/20
4,070,722 A 1/1978 Sutherland
4,106,145 A 8/1978 Gillen et al.
4,300,253 A 11/1981 Anderson
6,129,034 A 10/2000 Santa Cruz et al.
2002/0129756 A1 * 9/2002 Myers ..... 114/354

* cited by examiner

*Primary Examiner*—Ed Swinehart
(74) *Attorney, Agent, or Firm*—Jones Waldo Holbrook & McDonough, PC; Wade N. Sherman; Brent T. Winder

(57) ABSTRACT

A boat mounted hunting blind to aid hunters in hunting game, particularly water fowl; wherein, at least two pontoons are connected together, preferably in parallel orientation, by way of a bridging platform. Above the platform there is hingedly attached a collapsible canopy, preferably camouflaged in design, within which the hunter may be concealed in a seated or standing position while scouting and shooting game. Above the canopy there is removably attached a detachable roof, preferably camouflage in design, for providing weather protection for the hunter and further concealment.

2 Claims, 4 Drawing Sheets

BOAT MOUNTED HUNTING BLIND

BACKGROUND OF THE INVENTION

Field of the Invention

The present invention relates generally to a hunting blind. Specifically, there is disclosed a hunting blind mounted atop a pontoon-based water craft which is particularly suited to facilitate the carrying of a hunter, or more particularly the concealing of a hunter, for aid in hunting game, particularly water fowl.

BACKGROUND AND PRIOR ART

The use of various water craft by hunters for floating bodies of water and hunting game is well known. Similarly, the use of hunting blinds, particularly for camouflaging hunters in riparian environments, is widely recognized and utilized as an essential tool in effective hunting. Often, these blinds are placed on the shore of a body of water from which the hunter may scout, shoot, and retrieve game. Alternatively, blinds are also known to be mounted to the gunwales of water craft for the added convenience of finding optimum hunting positions on the water while maintaining a concealed presence.

However, there are several challenges presented by utilizing blinds as described in the prior art. For example, hunting blinds provided in the prior art do not allow for a clear viewing chamber for the hunter to scout game. Many prior art patents teach blinds that require the removal of a flap or cover to allow the hunter to view game.

Further, the prior art provides for cumbersome methods of attaching blinds to a water craft, not being easily collapsible or detachable for transport or storage. Similarly, the prior art teaches the application of boat mounted hunting blinds over single hull crafts, which are difficult for hunters to mount and/or dismount when necessary.

The following United States patents are herein incorporated by reference for their supporting teachings:

1) U.S. Pat. No. 3,787,912 issued to Huey, Jr. discloses a one man containing hunting blind. The device consists primarily of a floating device with protective compartment means for a single hunter, the device includes transom means for an outboard motor, the hull portion having compartment means for gas tanks, fire extinguisher and other necessary items for a hunter;
2) U.S. Pat. No. 6,129,034 issued to Santa Cruz et al. discloses an accessory cover device which is removably attachable to an open-top boat, with the cover being of a size and shape to provide comfortable shelter for the user. The cover is portable and easily assembled while the user is in the boat;
3) U.S. Pat. No. 4,106,145 issued to Gillen et al. discloses a shroud supporting frame structure extending transversely from an open boat and connected with its gunwales to form a weatherproof collapsible concealing cover for a hunter;
4) U.S. Pat. No. 4,300,253 issued to Anderson discloses a quick assembly blind for use in combination with an open top boat. The blind comprises generally a rectangular framework releasably secured to the boat and extending above the boat; and
5) U.S. Pat. No. 4,070,722 issued to Sutherland discloses a hunting blind in the form of a covered superstructure adapted to seat upon the gunwales of a boat hull and having a top wall including an elongated, elevated roof structure having a batch opening and a hatch adapted to open and close the hatch opening.

SUMMARY OF THE INVENTION

The present invention relates to a boat mounted hunting blind to aid hunters in hunting game, particularly water fowl. A principal potential feature of this invention is to provide a boat mounted blind apparatus which can be quickly and easily collapsed or detached for transport or storage, which allows a hunter to view game and shoot from an open and wide angle within the boat, and which is suitable for installation over a pontoon based boat to facilitate maneuverability and ease of mounting and dismounting of the hunter.

Therefore, it is an advantage of the present invention to incorporate the use of a boat mounted hunting blind; wherein, at least two pontoons are connected together, preferably in parallel orientation, by way of a bridging platform. The bridging platform serves as a place for the hunter to ride or rest while scouting game, and to mount or dismount the boat during retrieval or otherwise. The platform is of a design and material, such as plywood wrapped in a water proof material, that adequately supports the weight of the hunter, and that is able to maintain a strong connection to the pontoons. Above the platform there is hingedly attached a collapsible canopy, preferably camouflaged in design, within which the hunter may be concealed in a seated or standing position while scouting and shooting game. Above the canopy there is removably attached a detachable roof, preferably camouflage in design, for providing weather protection for the hunter and further concealment.

Additional features and advantages of the invention will be set forth in the detailed description which follows, taken in conjunction with the accompanying drawings, which together illustrate by way of example, the features of the invention.

BRIEF DESCRIPTION OF THE DRAWINGS

In view of these objects which will become more readily apparent as the nature of the invention is better understood, the invention consists of the novel combination of parts, hereinafter more fully described with like numbers corresponding to like elements between drawings, illustrated and claimed with reference to the appended figures wherein:

DETAILED DESCRIPTION OF THE ILLUSTRATED EMBODIMENT

Figure 1:
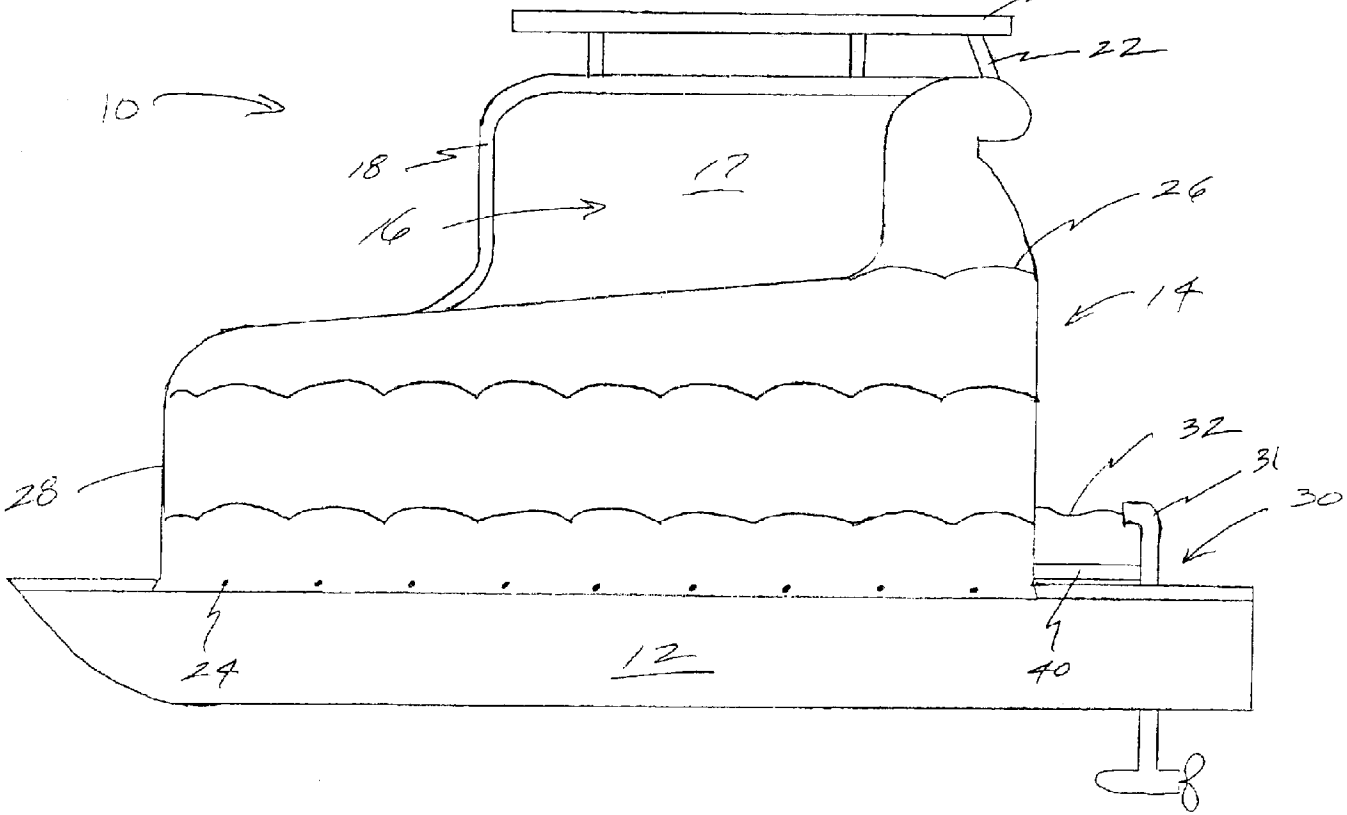
FIG. 1 is a side view of an illustrated embodiment of a boat mounted hunting blind 10.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The present invention is used in the typical environment in which hunting blinds, specifically boat mounted hunting blinds, are utilized by hunters for concealment while hunting game, particularly water fowl, but where it may be advantageous to provide a boat mounted blind that can be quickly and easily collapsed or detached for transport or storage, allows a hunter to view game and shoot from an open and wide angle within the boat, and is suitable for installation over a pontoon based boat to facilitate maneuverability and ease of mounting and dismounting of the hunter. Some advantages over the prior art may lie principally in that the present invention accomplishes the aforementioned tasks by providing a unique frame for the camouflaged canopy and a unique pontoon and platform design to facilitate mounting and dismounting the boat.

Referring now to FIG. 1, there is shown a side view of an illustrated embodiment of a boat mounted hunting blind (the "blind") 10. Specifically, the blind 10 is comprised of two elongated buoyant pontoons 12 which are preferably parallel to each other in orientation. The pontoons 12 are connected by a platform (see reference number 48 of FIG. 2), which is fastened to a top side, or sky facing side, of the pontoons 12.

Figure 2:
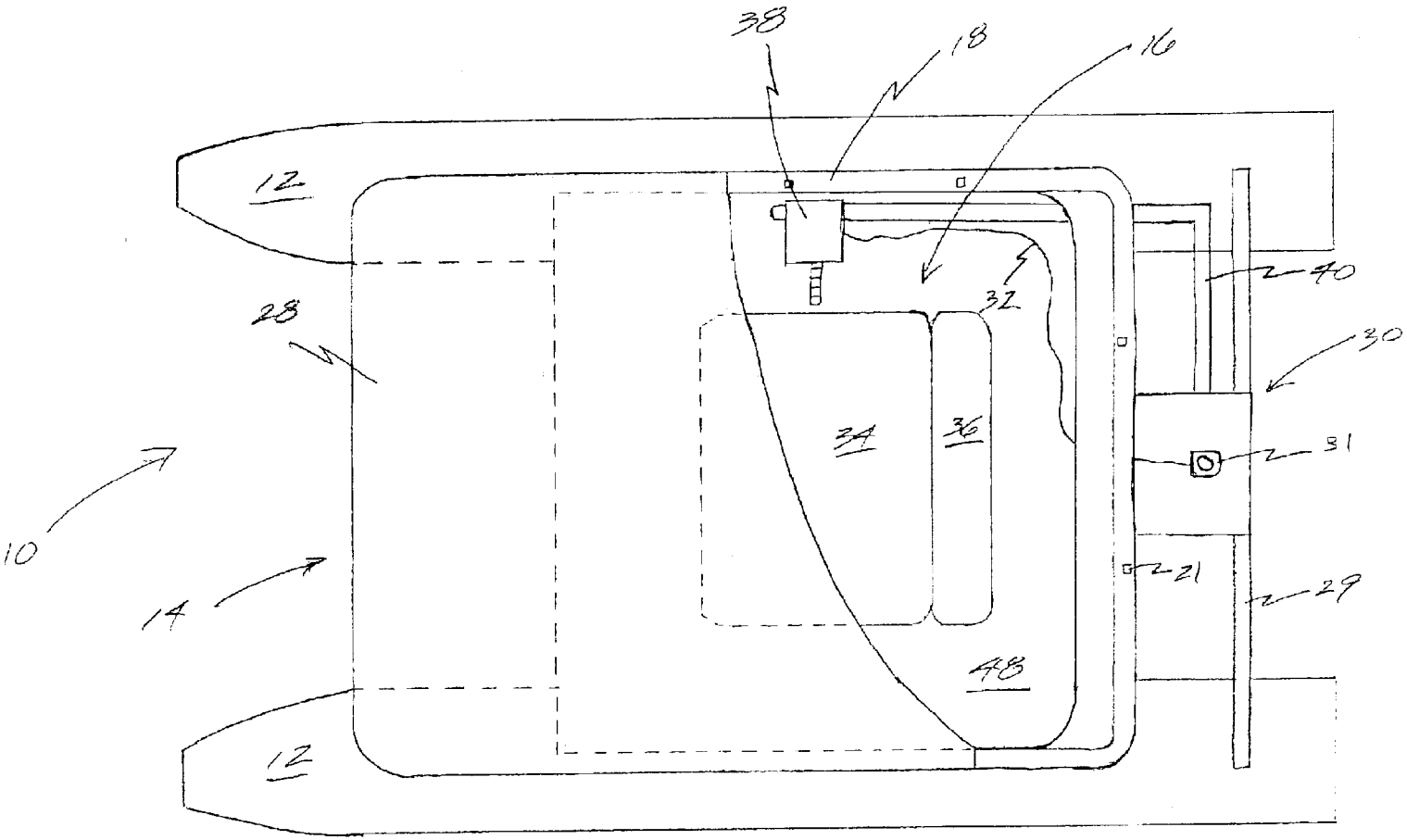
FIG. 2 is a top plan view of an illustrated embodiment from FIG. 1 with detachable roof 20 and support pegs 22 removed.
Figure 3:
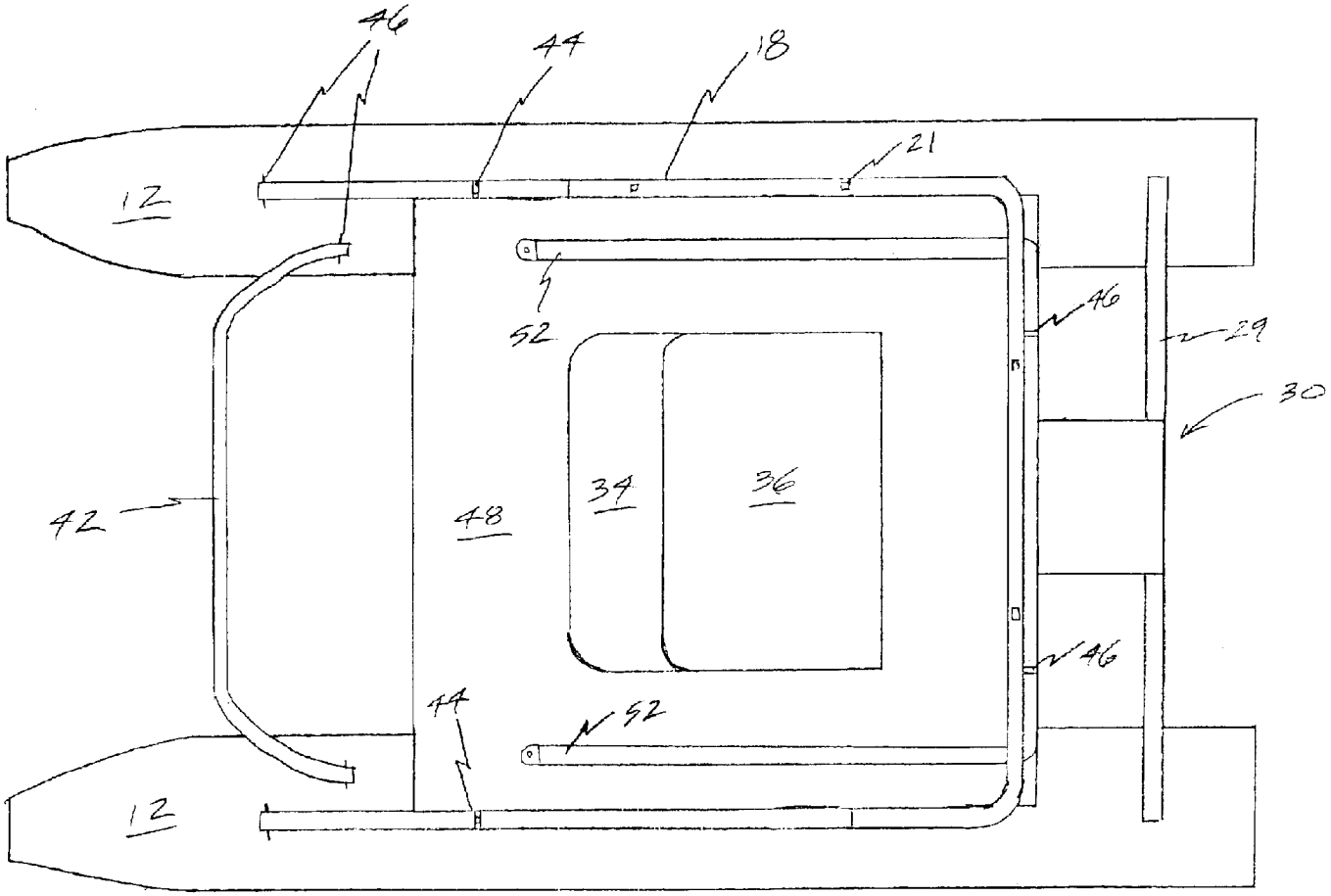
FIG. 3 is a top plan view of a boat mounted hunting blind 10 of FIG. 1 in collapsed position with canopy skin 28 removed.
Figure 4:
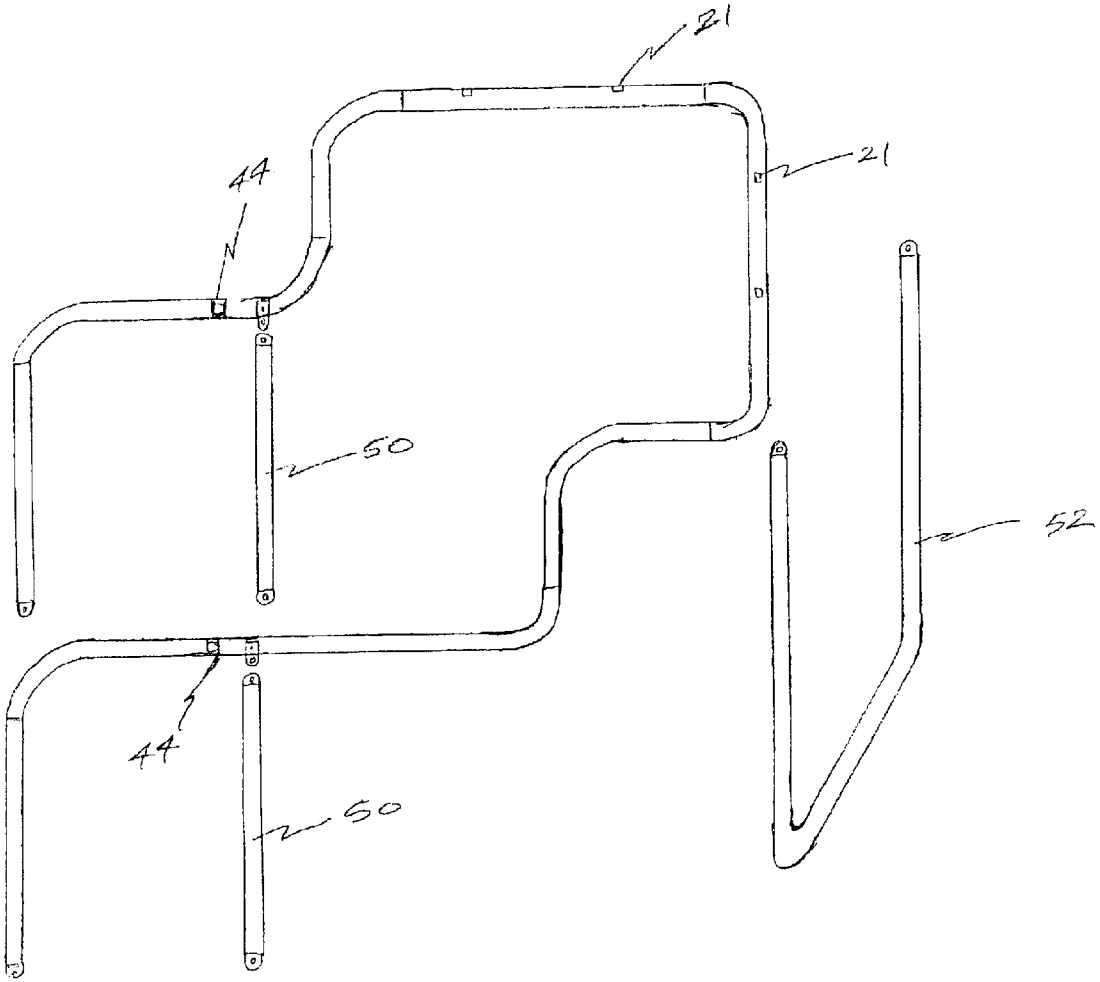
FIG. 4 is a perspective view of the canopy frame 18 for the boat mounted hunting blind 10 of FIG. 1 with canopy skin 28 removed.

FIG. 1 also shows a camouflaged canopy 14 in its fully extended and standing position. A frame of the canopy 18 consists of metal, plastic, or wood tubing, which is hingedly attached to the pontoon(s) 12, allowing the canopy 14 to be placed in an upright standing position (as shown in FIGS. 1, 2, and 4) or in a collapsed position (as shown in FIG. 3). The canopy's 14 exterior consists of a skin 28, which may be constructed of canvas, nylon, cordura, or a similar strong and flexible material, preferably maintaining a camouflage pattern to disguise the blind 10 and a hunter (not shown) within. The skin 28 maintains brush loops 26 for placing bundles of grass, twigs, or similar natural flora to aid in camouflaging the blind 10. The skin 28 may be attached to the pontoons 12 with snaps or similar fasteners 24.

FIG. 1 additionally illustrates a hunter's station 16 within which the hunter may ride, scout game, maneuver the boat, shoot, gather game, mount, and/or dismount the blind 10. Above the hunter's station 16 there is removably attached to the canopy frame 18 a detachable roof 20. The detachable roof 20 is attached to the canopy frame 18 via support pegs 22 corresponding to peg receptacles (see reference number 21 of FIGS. 2, 3, and 4) in the canopy frame 18. FIG. 1 also shows a depiction of a trolling motor 31 with linkage wire and linkage arm 40 for allowing the hunter to maneuver the boat from within the hunter's station 16. The trolling motor mount 30 is used to support the trolling motor 31 and linkage arm 40.

Referring now to FIG. 2, which is a top plan view of an illustrated embodiment of the blind 10 with the detachable roof 20 and support pegs 22 removed, there is shown a seat 34 with seat back 36 for the hunter to recline in during use. When not in use, the seat back 36 may be folded down to facilitate transport or storage. The platform 48 forms the base upon which the seat 34 and seat back 36 are mounted, as well as the main structural member which connects together the pontoons 12. The trolling motor mount 30 is supported by a girder 29 which spans the pontoons 12 for adding supportive strength to the trolling motor 31 and linkage arm 40. The hunter may steer the trolling motor 31 with a remote steer box 38 mounted adjacent to the seat 34 within the hunter's station 16.

Referring now to FIG. 3, which is a top plan view of a boat mounted hunting blind 10 of FIG. 1 in collapsed position with canopy skin 28 removed, there is shown a foot rest 42 for allowing the hunter to rest his/her feet while riding, steering, and/or scouting game. The foot rest 42 is hingedly attached to the pontoons 12 via conventional hinges 46, which allows retraction of the foot rest 42 to a flat position resting against the platform 48 for transport or storage. The canopy frame 18 contains two locking hinges 44 for allowing contraction of the frame 18 and for minimizing the profile of the frame 18 during transport or storage. A "U" shaped frame support 52 is shown lying in a flat position. The frame support 52 may rotated into a supporting position (as shown in FIG. 4) when the canopy frame 18 is in operation. The frame support 52 is attached to the platform 48 via conventional binges 46.

Referring now to FIG. 4, which is a perspective view of the canopy frame 18 for the boat mounted hunting blind 10 of FIG. 1 with canopy skin 28 removed, there is shown a set of detachable frame supports 50 for providing additional support to the frame 18.

VARIATIONS OF THE ILLUSTRATED EMBODIMENT(S)

It is understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. For example, in addition to the illustrated shape, it is noted that the canopy may also be assembled to facilitate a left handed shooter. The canopy frame may be assembled interchangeably with the hunter's station opening to either side of the boat. Similarly, variations in the size, and location of the hunter's station within the boat are also contemplated.

One skilled in the art would recognize that any number of conventional fastener types or shapes would be appropriate for the platform to pontoon connections, as well as for the hinges used to attach the canopy frame material, the foot rest and the frame support to the pontoons or platform. Similarly, the locking hinges used to allow the frame to "break down" may be of various type as recognized by one skilled in the art.

The illustrated boat may also be modified to include a greater number of, or larger or smaller, pontoons. In addition, as one skilled in the art would easily recognize, variations in the method of attaching the canopy skin 28 to the frame are contemplated. For example, the canopy skin may be attached with hook and loops or with zippers sewn into the fabric. In addition, the location of the brush loops may be altered. For example, the brush loops may be spaced more widely apart to accommodate larger twigs/branches.

Although the illustrated embodiment has generally been discussed in relation to use as a hunting blind, a skilled artisan of the water craft art will easily contemplate many other applications. For example, the present embodiment could easily be used for military applications or any similar application that requires the concealment of the operator, not necessarily with the intention to hunt game.

In addition, variations on the density, type, and color of the various elements are contemplated. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A boat mounted hunting blind, comprising:

a flotation means, having at least two pontoons connected together:

b) at least one base platform, mounted atop the pontoons and connecting the pontoons together;

c) a canopy, hingedly mounted atop the pontoons and base platform, the canopy including:

i. an interchangeable canopy frame, which has at least two mid-frame locking hinges, at least two roof peg receptacles, and which rests upon at least two frame supports, which may be interchangeably connected or retracted to a flat position; and ii. a canopy skin, secured to the canopy frame and the pontoons, which canopy skin contains a series of integrated brush loops;

a detachable roof, hingedly mounted atop the canopy;

e) a motor mounting platform, secured to the base platform and pontoons; and f) an operator's station, located within a central portion of the boat mounted hunting blind.

2. The boat mounted hunting blind of claim 1, wherein the operator's station further comprises:

a) an operator's seat and seat back, secured to the platform, which may be folded to a folded position; and a foot rest, hingedly attached to the pontoons, which may be retracted to a flat position.

* * * * *